United States Patent [19]

Patton

[11] Patent Number: 4,648,647

[45] Date of Patent: Mar. 10, 1987

[54] LOAD HANDLING APPARATUS

[76] Inventor: Charles W. Patton, 2881 Canton Rd., Uniontown, Ohio 44685

[21] Appl. No.: 504,505

[22] Filed: Jun. 15, 1983

[51] Int. Cl.[4] ..... B66C 1/00; B66C 23/26; B66C 23/78; B66C 7/00

[52] U.S. Cl. ..... 294/67.1; 212/182; 212/189; 212/195; 212/214; 212/217; 212/218; 212/225; 212/254

[58] Field of Search ..... 212/195, 182, 205, 210–211, 212/221, 225, 265; 294/67.1

[56] References Cited

U.S. PATENT DOCUMENTS

| | | | |
|---|---|---|---|
| 246,732 | 9/1881 | Davy | 212/227 |
| 700,162 | 5/1902 | Wiley | 212/225 |
| 3,087,635 | 4/1963 | Rönnsäter et al. | 212/225 |
| 3,103,395 | 9/1963 | Winberg | 212/217 |
| 3,955,844 | 5/1976 | de Castella et al. | 212/195 |

FOREIGN PATENT DOCUMENTS

| | | | |
|---|---|---|---|
| 185826 | 10/1963 | Sweden | 212/227 |

*Primary Examiner*—Sherman D. Basinger
*Assistant Examiner*—R. B. Johnson
*Attorney, Agent, or Firm*—L. A. Germain

[57] ABSTRACT

A long beam having designated forward and rearward ends includes a mounted load trolley for carrying and moving a load along a portion of its length, which beam is adapted for being carried aloft in a substantially horizontal attitude by a high lift crane. The beam also carries a standing leg apparatus at its forward end and the load is carried by the trolley from a rearward stopped position that is axially aligned with the center of gravity of the apparatus to a forward off-loading position. The trolley is maintained at the rearward center of gravity position while the high lift crane carries the apparatus and the load aloft to a delivery location and the standing leg apparatus is lowered to a substantially vertical position with respect to the horizontal attitude of the beam to take the weight of the load when the trolley is moved off of the center of gravity position for delivery and off-loading of the load at the forward end of the beam.

4 Claims, 7 Drawing Figures

152
64
112
122
60
62
50
98
172
124
52
60b
170
98a
90
6
96
96a
94
94b
156
116
114
92
94a
90a
92a
34
32
54
82
136
154
154a
80
160
130
132
162
134
152
60c
56
158
174
126
128
120
76
150
70
78
58
74
60a
72
118
122
110b
110
110a
64
112
62
48
60
5

LOAD HANDLING APPARATUS

BACKGROUND OF THE INVENTION

This invention generally relates to material and/or load handling apparatus and more particularly to a positioning and off-loading apparatus as may be used in conjunction with high-lift cranes to carry, position, and off-load materials in ready access for personnel use.

For example, in the construction of a high-rise building it is conventional practice to use one or more of various type high-lift cranes in the building process to move heavy loads and/or bulky construction materials from the ground to various levels of the construction site. While these cranes are extremely useful in moving such loads vertically from the ground and/or horizontally where no obstructions exist, they are limited to the extent that such loads cannot be easily positioned within a confined or overcovered area. For example, a crane that is positioned above a high rise construction may easily lift many thousands of pounds of material vertically to any level of the construction. However, in order to off-load said materials at a specific level or floor, an extension of the floor outward1y of the building must be provided so that the load may be vertically lowered onto the floor extension, disconnected from the crane hooks, and thereafter moved into the building for use. Naturally, to provide such floor extensions at every floor level to off-load building materials is a dramatic waste of time, effort, and expense in the construction process. This is true even though the floor extension may be a portable unit since such units must be safety-secured to the building, must be sufficient to carry the heavy loads, and are not easily moved to various other areas of the same floor level.

To alleviate these and other problems I have developed apparatus to be used in conjunction with high-lift cranes that enable construction workers to off-load heavy and/or bulky loads of materials directly onto the floor level without resort to floor extenders or extensions. One such apparatus is a prior art device that I developed and which is illustrated in the drawings and will be described in detail hereinafter.

By way of example, FIG. 1 of the drawings is illustrative of my prior art apparatus generally indicated by reference numeral 10. The apparatus 10 comprises a main boom member 12 that carries one or more telescoping minor boom members 14*a* and 14*b* respectively within its framework and these may be extended or retracted in accordance with the type and weight of a load "L" to be carried by the apparatus 10. The main boom member 12 has two top-mounted eye flanges 16 that accept cable hookups from a crane hoist indicated generally at 18, which hoist carries the apparatus 10 aloft for delivery of a load "L" to various levels of the construction site. Positioned at the outer extent of one end 10*a* is a load hook 20 and it will be immediately recognized by those knowledgeable in the load handling arts that a load "L" positioned at 10*a* must be counterweighted at the opposite end 10*b* such that the boom apparatus 10 remains in a substantially horizontal attitude during the lifting operation. In this circumstance, I have mounted a counterweight 22 on the main boom member 12 that is automatically movable therealong such that various load weights at 10*a* may be correctly compensated. To accomplish movement of the counter-weight 22, I have provided an electric motor (not shown) within the confines of the main boom framework and the required battery power and drive mechanism such that an electric control 24 may be used to position the counterweight at the proper position along the boom 12 for load compensation. The control 24 has a "forward" button for moving the counterweight in one direction and a "reverse" button for moving the counterweight 22 in the opposite direction along the boom 12.

The counterweight 22 is a block of a heavy material such as lead of approximately 2,000 pounds and additional 1,000 pound blocks may be added to a capacity of about 4,000 pounds. At capacity, the apparatus 10 may lift loads "L" of about 12,000 pounds. It should now be appreciated that the above described apparatus 10 allows a conventional vertical lift crane to carry a material load "L" to a particular floor level of a construction site and off-load said material directly into a building and onto a floor level without resort to exterior floor extensions. While the booms 14*a* and/or 14*b* may be extended to increase the horizontal reach of the apparatus 10, the counterweight 22 is movable toward the load such that it lowers it to the floor for disconnection.

While the above-described prior art apparatus 10 works well in its intended application, it does suffer from various disadvantages. These disadvantages include (a) the overall weight of the apparatus due to the counterweight limits the load capacity to be carried, (b) the total amount of counterweight is limited by the structural limitations of the booms, (c) the movable distance of the counterweight to compensate the load "L" is limited, (d) the extensibility of the minor booms to move the load away from the center-of-lift of the main crane for off-load positioning is limited, (e) the required battery power and motor drive to move the heavy counterweight along the main beam for load compensation is limited by weight considerations, and (f) the fact that the load "l" is carried at one end of the apparatus while it is being positioned for off-loading in close spaces presents a hazard.

To this end, my present invention is a marked improvement over the prior art in that it completely eliminates the requirement for counterweighting a load. Additionally, the present invention eliminates telescoping booms and the manner of their mounting within the main boom member and each other but instead provides a much simpler and stronger beam construction that is capable of carrying extremely heavy loads. Further, the present invention more advantageously carries a load "L" at the center-of-gravity of the apparatus during the lifting operation. The load "L" is therefore carried axially through the center-of-lift of the main lifting crane hookup which inherently has a greater lifting capacity. Eliminating the the counterweight of the prior art apparatus has the added benefit of significantly reducing the weight of the apparatus, which weight may instead be transferred to actual load carrying capacity. In addition, carrying the load "L" at the center-of-gravity allows for more easily positioning of the forward off-loading end into confined spaces and enhances the overall safety of the apparatus.

SUMMARY OF THE INVENTION

The above-mentioned advantages of the present invention will become apparent as the description proceeds and these are provided in a load handling and positioning apparatus for use in combination with a high-lift crane hoist comprising:

a long beam having designated forward and rearward ends and means affixed to the beam for connection to the crane hoist so as to be carried aloft in a substantially horizontal position;

a load trolley mounted on the beam and movable along a substantial portion of its length from a stopped rearward load carrying position to a stopped forward load depositing position, the rearward position being oriented along a line passing through the center of gravity of the apparatus;

power drive means mounted toward the rearward end of the beam;

means interconnecting the trolley to the power drive means to move the trolley along the beam from its rearward position to the forward position; and leg stand means mounted to the forward end of the beam for positioning to a substantially orthogonal orientation with respect to the length of the beam to provide a stationary off-loading and weight carrying mechanism to the forward end when the trolley moves off the center of gravity rearward position toward the forward load depositing position.

DETAILED DESCRIPTION OF THE INVENTION

Figure 2:
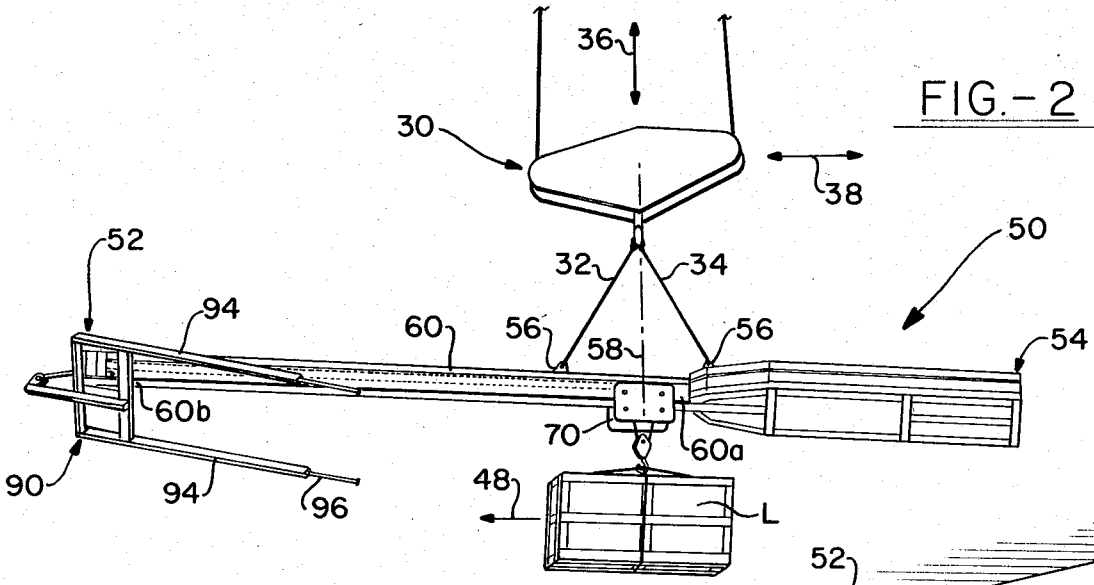
FIG. 2 is a perspective view of my improved invention for a load handling and positioning apparatus illustrating the manner of its operation in conjunction with a high-lift crane.

Referring firstly to FIG. 2 of the drawings, my new load handling apparatus is generally indicated by reference numeral 50 and is illustrated as it is intended to be used and carried aloft by a high-lift construction crane (not shown). The apparatus 50 may be used with any of various type high-lift cranes, whether a mobile ground-based unit or a stationary above-ground unit, and these are conventionally positioned such that building materials may be moved either vertically or horizontally about the construction site as indicated by directional arrows 36 and 38 respectively.

The apparatus 50 is characterized by a forward end indicated at 52 and a rearward end indicated at 54 and a pair of eye flanges 56 that are mounted on top of the apparatus in spaced relationship to each other and between the ends 52,54 and which facilitate connection to a crane hookup generally indicated at 30. The hookup connection is accomplished via cables 32 and 34 and these are attached to the eye flanges 56 at their lower ends and to the crane hookup 30 at their upper ends in the usual and conventional manner.

Figure 1:
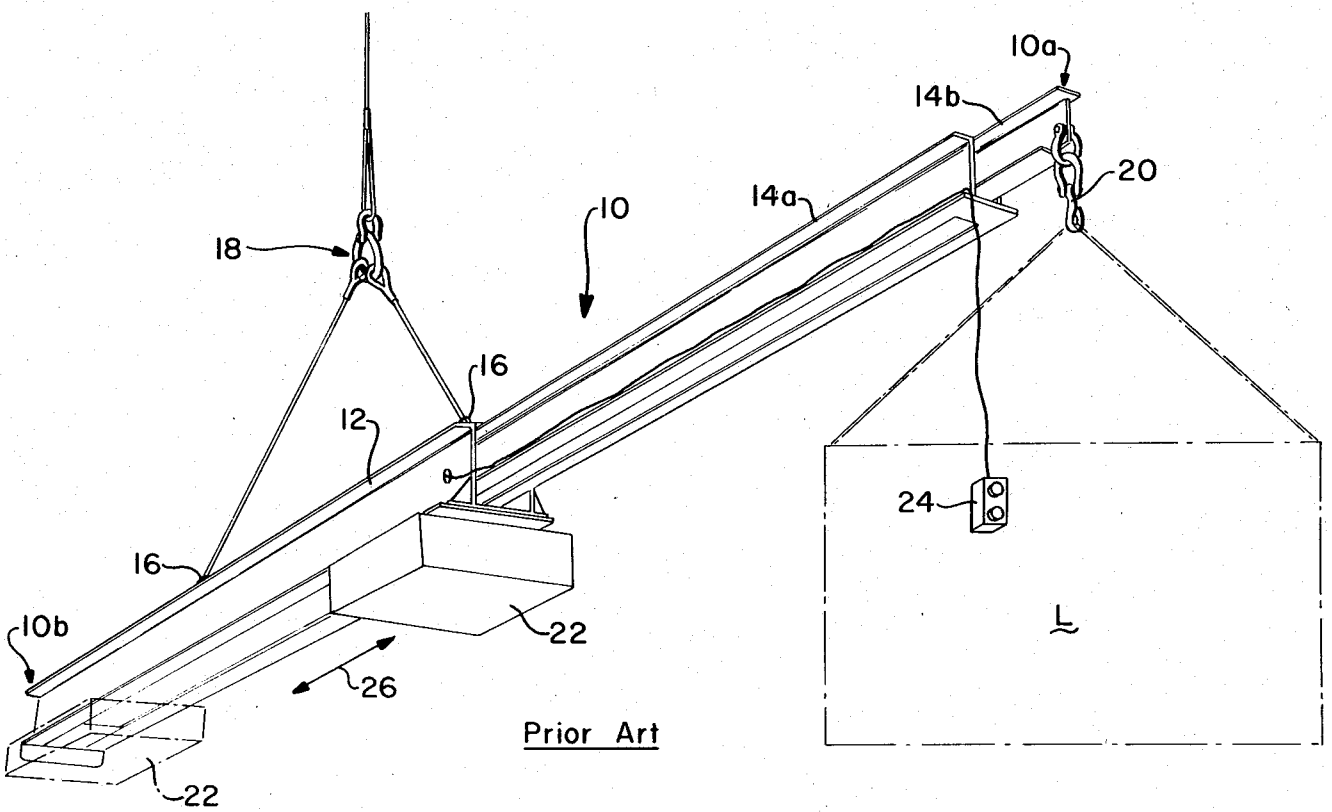
Prior Art FIG.-1
FIG. 1 is a perspective view of a prior art load handling and positioning apparatus illustrating the manner of its operation.

It should be noted and understood at the outset, that my new apparatus 50 is specifically designed such that when carried aloft by the crane hookup 30 in an unloaded condition, that is absent a load designated at "L", it is perfectly balanced in a horizontal plane. More precisely, the center-of-lift of the crane hookup 30 is axially aligned through the centroid or center-of-gravity of the apparatus 50 as indicated by the dashed-dot line 58. Furthermore, when a load "L" is carried by my apparatus 50, it also is positioned axially along the line 58 through the center of gravity. This is an important advantage in that the load "L" is always carried axially through the center-of-gravity while positioning of the apparatus for off-loading or depositing of the load "L". In this circumstance, there is absolutely no requirement to counterweight the load which is obviously necessary with the prior art apparatus illustrated in FIG. 1 of the drawings.

To continue, the apparatus 50 more specifically comprises a long beam member 60 that carries a movable load trolley 70 from a rearward stopped position at **60*a* to a forward stopped position at 60*b*. The rearward position at 60*a* is in axial alignment through the center-of-gravity along-line 58 and the load "L" remains in this position while it is being carried aloft to a specific unloading location. So as to maintain the apparatus in a substantially horizontal attitude when the load "L" is moved to the forward position at 60*b* for unloading, a standing leg apparatus indicated generally by reference numeral 90 is provided. The apparatus 90 comprises legs 94 that are moved to a substantially vertical position such that the weight of the load "L" is transferred to the legs as the trolley moves in the direction of arrow 48 to the forward unloading position at 60*b* and this operation will be described with reference to FIG. 3**.

Figure 3:
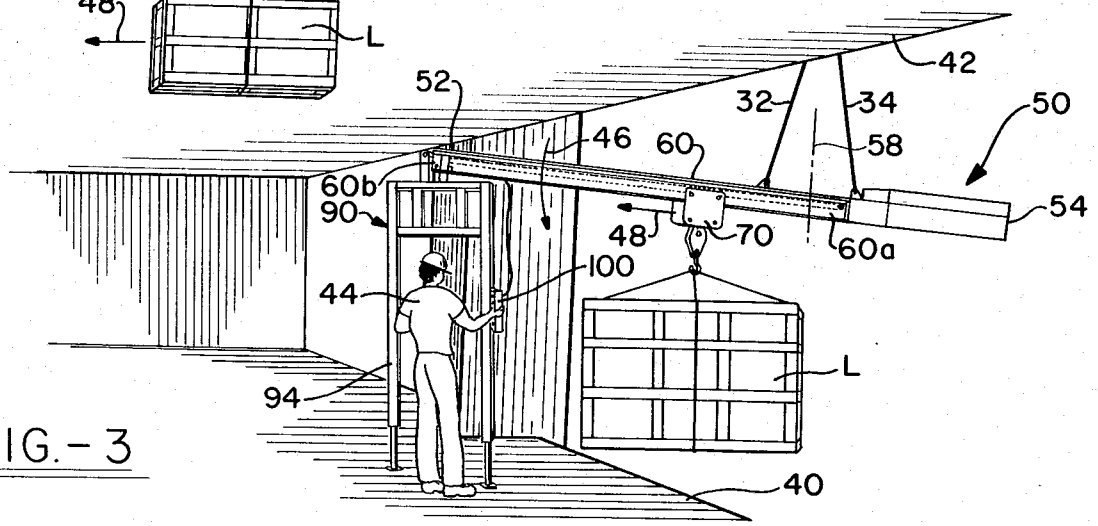
FIG. 3 is a pictoral illustration showing my new load handling and positioning apparatus as it may be used to off-load a load "L" at a typical construction site.

Referring to FIG. 3, the apparatus 50 is illustrated as it is used to position a load "L" onto a floor level of, for example, a high rise building. To accomplish this, the high-lift crane which carries the apparatus via cables 32,34 moves it vertically and horizontally aloft to the particular floor level. Upon reaching the desired level the crane moves the forward end 52 into the building through an opening which may be a window opening or the like as defined by the building floor 40 and ceiling 42. During the vertical lifting operation, the load "L" remains at the rearward stopped position at **60*a* until the forward end 52 is in position within the building for unhooking of the load "L". When in position, an operator 44 lowers the legs 94 to their substantially vertical downward position and then proceeds to move the load "L" along the beam 60 to the forward position at 60*b*. As the load "L" moves off the axial center through the center-of-gravity at 60*a* and in the direction of arrow 48, the weight is transferred in the direction of arrow 46 and toward the forward end causing the legs 94 to rest on the floor 40. The load "L" continues to move along the beam 60 into the building until is stopped at 60*b* whereupon personnel 44 may lower it to the floor 40 and unhook it from the apparatus 50. Once the load "L" is removed, the load trolley 70 is returned to its original stopped position at 60*a* and the legs 94 are retracted to their original position. The forward end 52 of the apparatus 50** is then moved out of the building opening and the apparatus is returned to the ground for another load pickup.

While the beforementioned operation may be carried out via hand operated mechanical controls, the preferred embodiment of the apparatus 50 utilizes hydraulic and/or electrical means to position the trolley 70 and the leg apparatus 90. For example, an electric motor, hydraulic pump, actuator and/or drive unit may be mounted in the rearward portion 54 of the apparatus 50 and these may provide the requisite automated control of the trolley such as to move it along the beam 60 via a control 100 operated by the personnel 44. By the same token, the legs 94 may be hydraulically operated by the same pump and motor and also controlled by the operator 44. While various alternative means may be used, a specific embodiment will be described hereinafter which offers excellent control of all working elements of the apparatus 50.

Figures 4A, 4B:
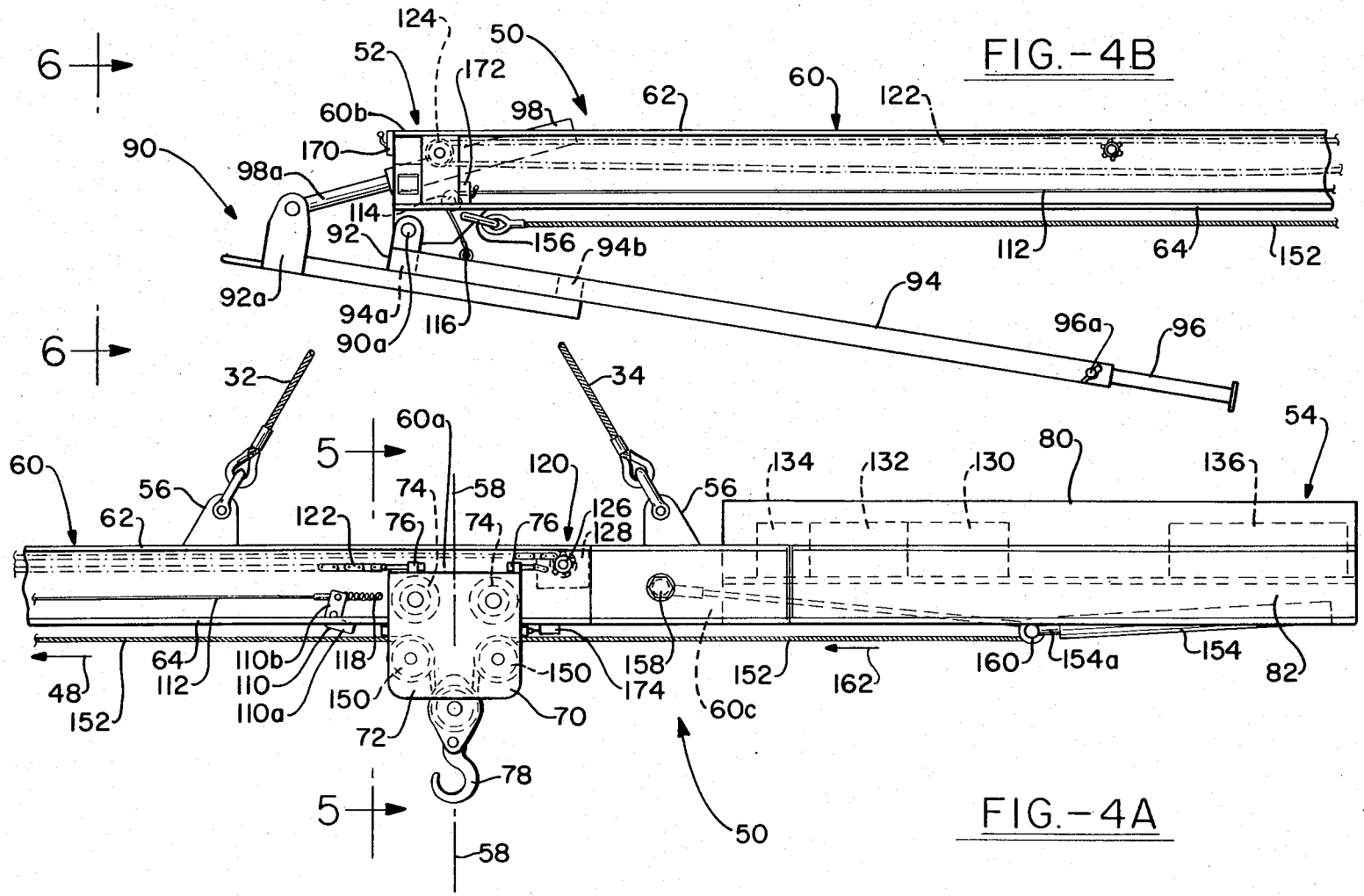
FIG. 4A is an elevational view of one end portion of the load handling apparatus illustrated in FIG. 3.
FIG. 4B is an elevational view of the opposite end of the load handling apparatus shown in FIG. 4A and illustrated in FIG. 3.

Referring now to FIGS. 4A and 4B, a specific embodiment of the invention is illustrated. Because of the length of the total apparatus 50, FIG. 4A illustrates approximately one-half of the apparatus including the rearward end 54 while FIG. 4B illustrates the remaining half including the forward end 52. As described hereinbefore, the apparatus 50 comprises a main beam member 60 which is preferably an H-section beam. While other section members may be used, an H-section provides the lateral strength required for a structure of this type. It is, however, anticipated that other beam section types may be used, such as for example an I-section beam, but these must be strengthened against lateral bending moments and the invention is therefore not considered limited by the specific type of beam used. Also the size of the beam 60 will vary depending upon the type of load to be carried by the apparatus 50. For example, an apparatus 50 having a total weight of 1840 pounds was built in accordance with the teachings of this invention utilizing a 10 in. H-section beam and it provides sufficient strength to carry a maximum load of about 6,000 pounds.

To continue, the beam 60 is characterized by a top flange 62 and a bottom flange 64 and the rearward end is terminated at **60*c* within a housing generally indicated by reference numeral 80. While the beam 60 may extend through the full length of the housing 80, it is terminated at some shorter distance such as at 60*c*. The reason for this is that the housing 80 may be built of steel channels 82 to define a box-like structure for mounting various control elements therein as will be described hereinafter. Thus, the weight of the additional length of beam 60, when extending the full length of the housing 80, is more conveniently replaced by the weight of the housing structure which must be designed such that the center-of-gravity of the apparatus 50 is located at a convenient point along the length of the beam 60**.

Figure 5:
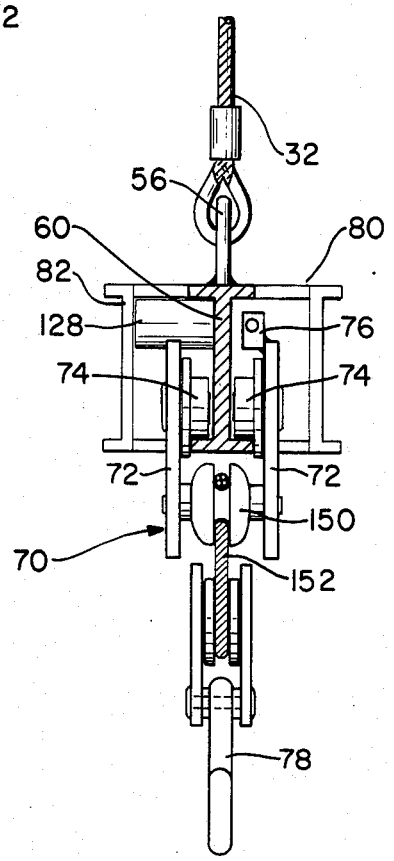
FIG. 5 is an end view, partially in section, as may be taken on line 5—5 of FIG. 4A.

Continuing with reference to FIGS. 4A and 5, the apparatus 50 also comprises a load trolley 70 that is movable along the bottom flange 64 of the beam 60. The trolley 70 comprises a pair of side plates 72 between which are mounted a plurality of flange-riding rollers 74. It will be recognized by those knowledgeable in the crane arts that the trolley is not unlike many used on overhead chain-hoist type cranes typical in many industrial plants. In any event, the trolley 70 is caused to move along the beam 60 by a power drive system indicated at 120. The system 120 includes a chain 122 the end of which are attached to the top of one side plate 72 at 76. The chain 122 extends the length of the beam 60 toward the forward end at **60*b*, passes around a sprocket 124 and returns to pass around a drive sprocket 126. The drive sprocket 126 is rotated by a hydraulic drive mechanism 128 mounted on the opposite side of the beam 60, which in turn is operated by an electric motor 130 through a hydraulic pump 132 and switch means 134. The motor 130 is a D.C. motor operated by a battery pack indicated at 136. The drive mechanism 128, motor 130, pump 132 and switch means 134** are state-of-the art devices and therefore are only shown schematically in the drawing.

The trolley 70 also includes a load hook 78 that may be operatively raised and/or lowered through a double sheeve pulley system comprising pulleys 150, a cable 152, and hydraulic actuating means 154 mounted within the housing 80 in the rearward portion of the apparatus 50. One end of the cable 152 is affixed to the forward end of the apparatus at 156 shown in FIG. 4B while the opposite end is connected at the rearward end 54 via a pin 158. The hydraulic means 154 is an actuating cylinder having a piston driven arm **154*a* a connected to a pulley 160 which carries the cable 152 through it. It will, of course, be recognized that movement of the arm 154*a* in the direction of arrow 162 will lower the trolley load hook 78 and this will be accomplished irrespective of the position of the trolley 70 along the beam 60. The actuator 154 may, of course, be hydraulically controlled through the same motor 130, pump 132, and switching means 134**.

Figure 6:
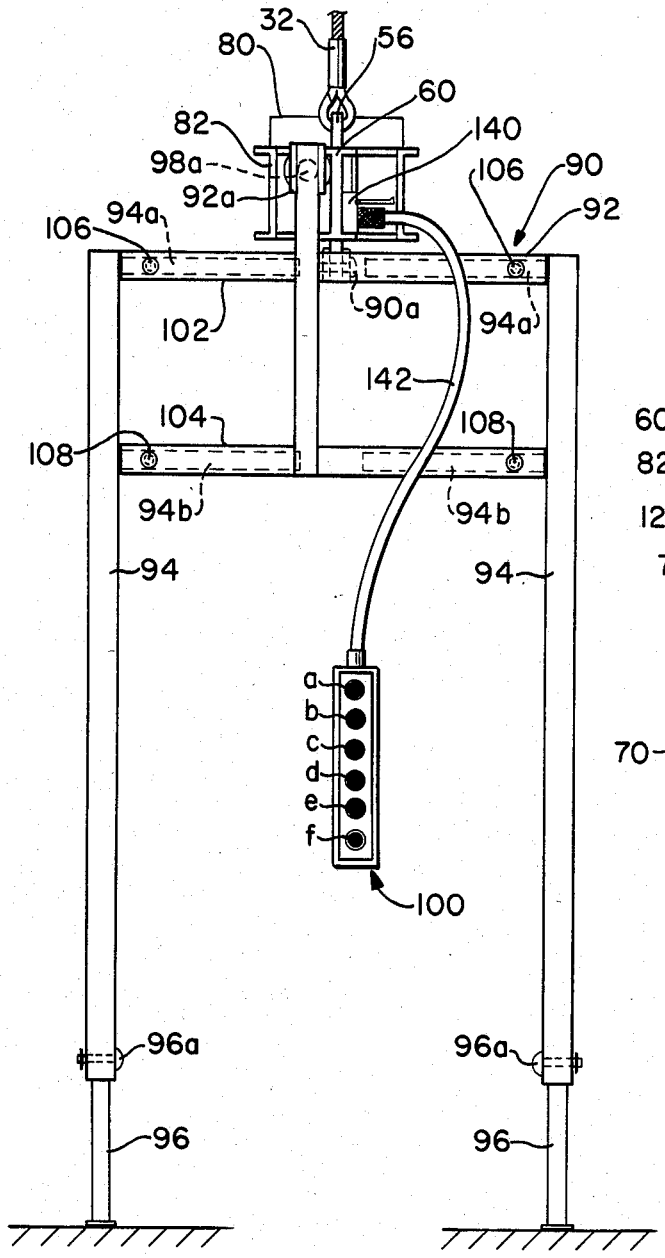
FIG. 6 is an end elevational view as may be taken on line 6—6 of FIG. 4B showing extendible legs in position for off-loading a load.

Referring now to FIGS. 4B and 6, the standing leg apparatus 90 is more specifically illustrated. The leg apparatus 90 comprises a main frame structure 92 having upper and lower tubular channels 102 and 104 respectively. Each leg 94 herebefore mentioned. has a telescoping extension 96 secured within its bore via a pin means **96*a* and these extensions may be used to adjust for various sized loads "L" that may be carried for off-loading by the apparatus 50 as clearly illustrated in FIG. 3 of the drawings. Each leg 94 is mounted to the main frame 92 by way of orthogonal extensions 94*a* at the upper end and 94*b* at the lower end and these are adapted-to be received within the bores of the cross tubular channels 102 and 104 respectively. The legs 94 are locked in place by pins 106 that pass through the upper members 102, 94*a* and by pins 108 that pass through the lower members 104, 94*b*. The legs 94 are raised and/or lowered by any desirable means which may be a simple hand operated mechanism or automated via hydraulically and/or electrically operated mechanisms. The drawing illustrates a typical hydraulic mechanism which includes a hydraulic actuator 98 operatively moving an arm 98*a* connected to an extension 92*a* of the leg frame 92. The leg apparatus 90 is connected via a pivot pin 90*a* to the forward end of the beam 60 and it will be readily recognized that operation of the arm 98*a* will raise and/or lower the legs 94. The actuator 98 may also be operated via the motor 130 and hydraulic pump 132 through the switch means 134**.

As already alluded to, operation of the various elements such as the trolley drive 120, the load hook 78, and the leg apparatus 90 are preferably accomplished via a single hydraulic system including a battery pack 136 powering a D.C. electric motor 130 which in turn powers a hydraulic pump 132 and a plurality of switches 134. The switching is controlled through a control panel indicated at 100 having a plurality of button controls a,b,c,d,e, and f. The control panel 100 is connected into a plug 140 at the forward end **60*b* of the beam 60 through a cable 142 that has sufficient length such that an operator 44 may readily make use of the controls as clearly illustrated in FIG. 3 of the drawings. The control buttons a–f may be in any designated order but preferably they should be in some logical sequence such as, for example, controls a,b may be designated to operate lowering and raising of the legs 94 while controls c,d may be designated to operate movement of the trolley in the forward and rearward directions along the beam and controls e,f may be designated for lowering and raising of the load via load hook 78. In this sequence an operator 44 will position the legs 94 in their downward off-loading orientation before attempting to operate the trolley along the beam 60. By the same token, the load hook 78** will not be lowered until the trolley is moved forward on the beam to an off-loading position.

In the operation of the load handling apparatus 50, a number of safety features are provided. For example, at the rearward end 60*a* of the beam 60 a mechanical stop 110 is mounted in the lower flange 64 such as to be in the pathway of the trolley 70 and thus keep it from moving in the forward direction of arrow 48. The stop 110 is in the form of a rotatable L-shaped member having a bottom portion 110*a* depending into the pathway of the trolley 70 and preventing its motion forwardly along the beam. An upper portion 110*b* is attached to a control cable 112 that is mounted at the forward end 60*a* of the beam 60 through a pulley 114 and affixed to the main frame 92 of the movable leg apparatus 90 at 116. A spring 118 is also attached to the upper portion 110*b* and acts to maintain the lower portion 110*a* in a downward position (shown) in the pathway of the trolley 70. The length of the cable 112 is such that when the leg apparatus 90 is in a substantially vertical position at the end of the beam 60, it pulls the stop 110 out of its "trolley stop" position and thus allows the trolley and its load "L" to move forward along the beam 60. Thus, the trolley may not be moved along the beam until the legs 94 are in their downward orientation to accept the weight of the load as it moves away from the center of gravity position.

In addition to the mechanical stop 110, the apparatus 50 also includes a relay switch 170 at the forward end 60*b* of the beam 60 that is also activated by the leg apparatus 90 when it is moved to its vertical or legs-down position. The relay 170 is electrically interconnected in the electric motor circuit and is normally in the "cut-off" position such that no current is fed to the motor 130 for hydraulic operation of the trolley drive system 120 as long as the legs 94 are in any position but the vertical position. Thus, both mechanical and electrical safety devices 110 and 170 respectively prevent accidental movement of the load trolley along the beam 60 when the legs are not in their full downward and load accepting position.

In addition to the safety stop 110 and switch 170, a further relay switch 172 is also positioned at the forward end of the beam at 60*b* such as to be activated by the trolley 70 when it reaches the full forward position. This switch is normally in a "cut-off" position such that the actuator 154 may not be operated to lower the load "L" until the trolley is in the full forward position at the forward end 60*b* of the beam 60. This is an off-loading safety that is not normally required when a load is picked up since at that time the legs 94 are normally in their "up" position.

A final safety feature is a switch 174 that is located at the rearward end 60*a* of the beam 60 and activated by the trolley 70 when it is at its "home" or full rearward position. The switch 174 will not allow the legs 94 to be raised from their vertical or downward position until the trolley 70 is completely back to its home position at the center of gravity 60*a*.

While the invention is illustrated and described with respect to an electric D.C. motor driven hydraulic system, it is anticipated that other equivalents may be used by those knowledgeable in the art to either move the trolley along the beam 60, to raise and/or lower the legs 90, or to raise and/or lower the load hook 78 and the invention therefore is not considered limited to any particular means whether mechanical, electrical, or hydraulic to accomplish the desired results.

What is claimed is:

1. Apparatus for use with a high-lift crane hoist to carry, position, and deposit a load comprising in combination:

a long beam having designated forward and rearward ends and comprising a vertical center rib interconnecting top and bottom orthogonal flanges and a pair of eye flanges mounted in spaced relationship along the top to provide connection to the crane hoist such that the beam may be carried aloft by the crane in a substantially horizontal attitutde;

a load carrying trolley mounted on and movable along the bottom flange of the beam from a rearward load carrying position to a forward load depositing position, the rearward load carrying position being in axial alignment with a line passing through the center of gravity of the apparatus and through the center of lift of the crane hoist, said trolley including a double sheeved mechanism for raising and lowering the load carried by the trolley;

a power drive system to move the trolley along the beam including a battery power pack, an electric D.C. motor, a hydraulic pump, and hydraulic switching means mounted in a housing at the rearward end of the beam, and a long drive chain having its ends affixed to the trolley, said chain passing around a drive sprocket at the rearward end and driven by a hydraulic drive interconnected to the hydraulic pump through the switching means;

leg stand means mounted at the forward end of the beam and adapted to be hydraulically rotated to a downwardly position to support the end of the beam when the trolley is moved forwardly off the center of gravity rearward position;

a hydraulically operated actuator mounted at the rearward end of the beam and associated with the double sheeved mechanism through a cable which effects raising and lowering of the load in response to the switching means and irrespective of the position of the trolley along the beam; and a control means positioned at the forward end of the beam and electrically interconnecting the battery power pack, the D.C. motor, and the hydraulic switching means in a circuit for selectively controlling the hydraulic operation of the trolley, the leg stand means, the actuator for raising and lowering the load, preventing movement of said trolley except where said leg is in a predetermined position, preventing raising of said leg except when said trolley is in a predetermined position and preventing lowering of a load except when the trolley is in a predetermined position.

2. The apparatus as set forth in claim 1 further comprising a relay switch within the control circuit and mounted at the forward end of the beam, said relay activated by the leg stand when it is in a full downwardly position such that the motor is inoperative and the trolley may not be moved along the beam except when the leg stand is in a full downwardly supporting position.

3. The apparatus as set forth in claim 2 further comprising a second relay switch in the control circuit and mounted at the rearward end of the beam and activated by the trolley when it is at the center of gravity position, said relay preventing raising of the leg stand except when the trolley is at the full rearward position.

4. The apparatus as set forth in claim 3 further comprising a third relay switch in the control circuit and mounted at the forward end of the beam in a position to be activated by the trolley when it reaches the full forward load depositing position, said relay preventing lowering of the load carried by the trolley when it is moved forwardly off the rearward center of gravity position but allowing lowering of the load when the trolley reaches the full forward load depositing position.

* * * * *